United States Patent [19]

Schillig

[11] Patent Number: 4,664,132

[45] Date of Patent: May 12, 1987

[54] MOTORIZED HAIR STYLING BRUSH WITH REMOVABLE DRYER

[76] Inventor: Kim Schillig, 32 Harriet La., Huntington, N.Y. 11743

[21] Appl. No.: 622,635

[22] Filed: Jun. 20, 1984

[51] Int. Cl.[4] ..... A45D 1/02; A46B 15/00; A46B 7/10; H05B 3/02

[52] U.S. Cl. ..... 132/11 A; 132/34 R; 34/96; 219/222

[58] Field of Search ..... 132/9, 11 A, 34 R, 34 A, 132/34 B, 34 C, 122, 151; 34/96; 219/222; 15/27

[56] References Cited

U.S. PATENT DOCUMENTS

| | | | |
|---|---|---|---|
| 1,759,265 | 5/1930 | Kunin et al. | 132/34 C |
| 2,400,723 | 5/1946 | Vrana | 132/120 |
| 2,448,263 | 8/1948 | Hannon | 132/34 R |
| 3,019,463 | 2/1962 | Mitchell | 15/23 |
| 3,204,469 | 9/1965 | Spillers | 74/22 R |
| 3,349,782 | 10/1967 | Sawin | 132/11 R |
| 3,386,453 | 6/1968 | Roberts et al. | 132/11 R |
| 3,491,774 | 1/1970 | Carbone | 132/9 |
| 3,894,547 | 7/1975 | Scivoletto | 132/11 A |
| 4,222,398 | 9/1980 | Fromman | 132/34 R |
| 4,419,565 | 12/1983 | McGaw | 132/34 R |
| 4,496,825 | 1/1985 | Andis | 132/34 R |

*Primary Examiner*—Gene Mancene
*Assistant Examiner*—David I. Tarnoff
*Attorney, Agent, or Firm*—Oblon, Fisher, Spivak, McClelland & Maier

[57] ABSTRACT

A motorized hair styling brush with removable dryer includes a rotatable hair brush mounted on a drive shaft which is driven by a reversible direct current motor. Torque is transferred from the drive shaft to the rotating brush through a thrust bearing that establishes a maximum torque deliverable to the hair brush. A thumb nut threadably mounted on the end of the drive shaft at the forward end of the hair brush compresses a spring within the hair brush to push the hair brush against the thrust bearing. Turning the thumb nut with respect to the drive shaft alters the maximum torque deliverable from the drive shaft to the hair brush. An external AC powered blower is provided with a mounting bracket that slips along tracks on the handle for easy engagement and disengagement. The dryer is configured generally rearwardly of the brush and blows air at an angle toward the brush. Alternating current for the blower and direct current for the brush motor are provided by a four-conductor electric cord connected at its far end to an AC/DC power supply.

6 Claims, 8 Drawing Figures

MOTORIZED HAIR STYLING BRUSH WITH REMOVABLE DRYER

SUMMARY OF THE INVENTION

The hand-held motorized hair styling brush of this invention may be used to fluff and dry wet hair of any length, but has been found to be of particular advantage for moderately short hair. Motorized rotating hair brushes per se are known, as in U.S. Pat. No. 3,491,774 of Carbone. It also is known to combine a motorized rotating hair brush or comb with a source of hot air, as in U.S. Pat. No. 3,894,547 of Scivoletto. However, this invention presents a number of novel features and benefits not present in such devices.

It has been discovered that an especially advantageous way of drying moderately short hair involves a motorized rotating hair brush used to pull the hair down and out away from the head, in contrast to the usual method employed while using a hand held manually rotated brush, which tires an individual's hand and wrist. Pulling the hair down and out away from the head using a slowly rotating circular hair brush makes the hair on an individual's head look thick and full. The preferred brush diameter and bristles recited in this description have been found empirically to work especially well in pulling moderately short hair down and out as it is being dried. The direction of rotation of the brush may be reversed to provide proper rotation for use on either side of the head while being held in either hand. Mounting a blower onto the same handle that houses the brush provides for ease of use, with the result that the drying is much easier than holding the dryer in one hand and a standard brush in another. The particular preferred blower configuration allows the hair free access to the brush.

The rotating brush is mounted on a drive shaft using a slip clutch which provides an upper limit of torque that the brush is able to transmit to the hair. A single threaded holding member both provides for easy adjustment of the maximum torque and allows for rapid interchangeablility of brushes. The reversible rotation of the brush is provided by a direct current motor. A mounting bracket fixed to the external dryer allows the dryer to be slipped on and off the handle. When the dryer is slipped onto the handle, an electrical connection is made automatically between pins in the mounting bracket and pins in the handle. The blower is powered by alternating current and is configured generally rearwardly of the brush, so that it blows hot air at an angle toward the brush. The handle is connected to an external power supply by an electric cord that contains four conductors. Use of a cord having four conductors allows the external power supply to provide both direct current for the brush motor and alternating current for the blower.

Among the particular advantages of the invention over known devices are as follows:

The use of a slip clutch to limit the maximum torque that the drive shaft may supply to the brush contributes to the safety of the invention and to the confidence of the user. Placing the slip clutch within the rotating brush noticeably shortens the overall length of the product and particularly the length of the handle. It also allows the use of a unitary drive shaft. If the slip clutch were in the handle, a break in the drive shaft would be required, thereby increasing manufacturing cost. Placing the slip clutch within the brush also allows for use of the threaded holding member, which may easily be turned by the user of the brush, thereby adjusting the maximum torque to suit his individual taste. Use of the threaded holding member also allows for easy interchange among various types of brushes.

The use of a direct current motor to provide for reversible rotation of the brush decreases both manufacturing cost and weight. If an alternating current motor were used, reversible gearing would be required to provide for reversible rotation of the brush.

Providing for rapid removability of the blower makes possible an optional decrease in weight if the user does not wish to use the blower, thereby making the device easier to use. Setting the blower back away from the brush on the handle and blowing air at an angle both provides easy access of the hair to the brush and creates a low moment arm between the wrist of the user and the blower, making use of the device easy. This blower configuration also allows for use of the optional baffle, where desired. The dryer is located on the handle opposite a switch that controls the rotation of the hair brush. This configuration allows the user to keep his finger on the switch at all times, thereby increasing safety and user confidence.

Use of alternating current to power the blower allows for high power dissipation within the blower, thereby providing high air-moving power and high air-heating power. Another factor contributing to high drying capability is the fact that the blower is mounted external to the handle, and consequently is limited in its air moving capability only by the design of the blower itself. This may be contrasted with the cited reference to Carbone, in which a small opening greatly limits the amount of air that may be provided.

The use of a dual power supply allows for use both of a direct current motor and an alternating current blower to be used. Locating this power supply at the remote end of the electric cord decreases the overall size and weight of the assembly while in use.

An important advantage of the invention is that it also can be used in the commercial market. A professional hair dresser would use the invention without the attached blower, by placing the brush and handle in one hand and a conventional blow dryer in the other. He would use them to style and dry a customer's hair repeatedly without producing wrist fatigue caused by continuous manual rotation of a conventional hair brush.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
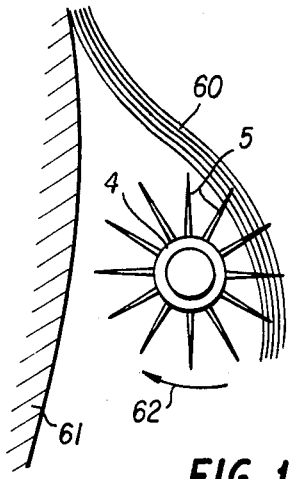
FIG. 1 illustrates the preferred mode of use of the rotating brush of the invention.
Figure 7:
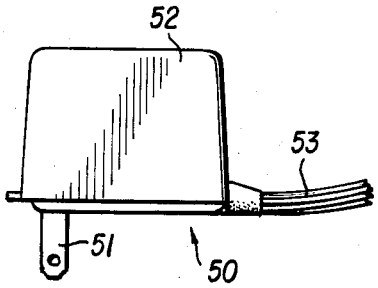
FIG. 7 is an external view of the power supply.
Figure 8:
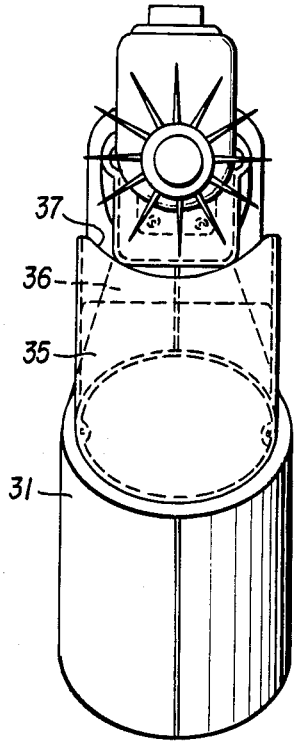
FIG. 8 is a forward end view of FIG. 2.
Figure 2:
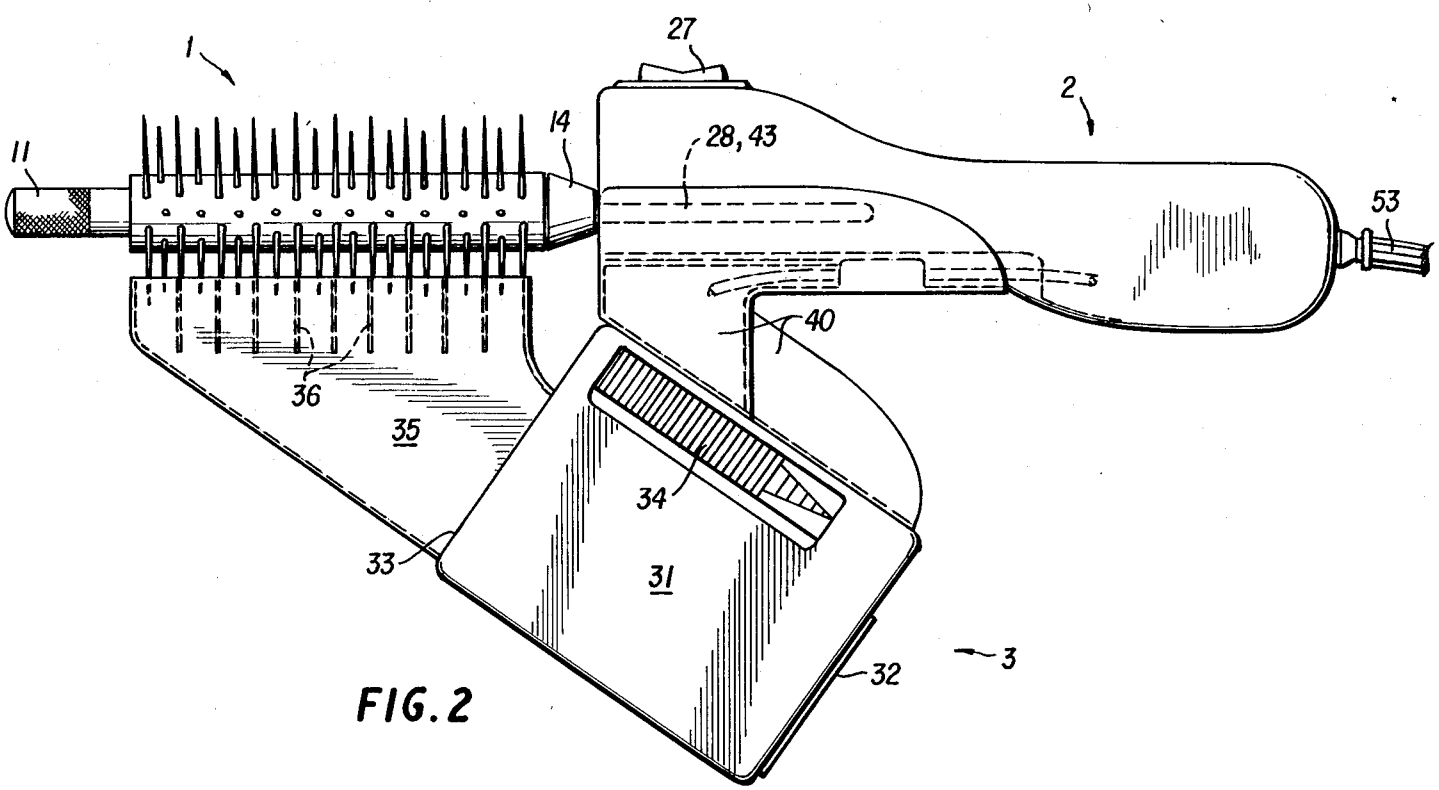
FIG. 2 is an external side view of the hand-held portion of the invention, showing the blower in place on the handle and the optional baffle in place on the blower.

FIG. 1 shows a forward end view of the rotating brush of the current invention in which the bristles 5 of the brush, rotating in the direction shown by arrow 62, pull the hair 60 down and away from the head 61 of the user. In FIG. 2 may be seen the hair brush assembly 1, the handle assembly 2 and the blower assembly 3. The blower 31 is attached to the handle assembly by mounting bracket 40, which serves as attachment means. Removable baffle 35 comprises fins 36, best seen in FIGS. 2 and 8, which serve at the option of the user to direct heated air leaving the blower outlet 33 into a direction normal to the rotating hair brush.

Figure 3:
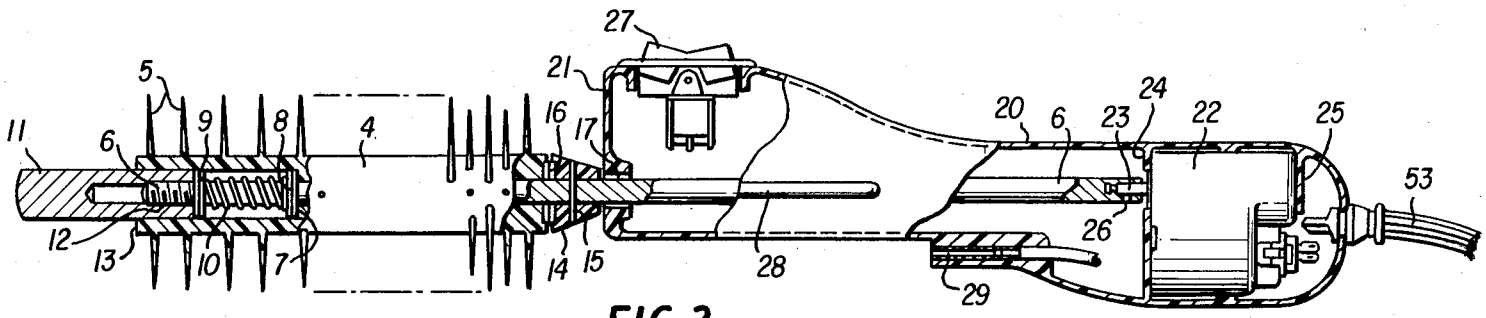
FIG. 3 is a view like that of FIG. 2, partly in section, and without the removable blower.

As best seen in FIG. 3, the hair brush comprises main body 4 and bristles 5. Although the hair brush may be of any size and general configuration preferred by the user, in a preferred embodiment, which has been found to be especially effective in drying moderately short hair, the main body has an annular cross-section having an outer diameter of 0.5 inch and a length of 4 inches. The outer diameter may be as great as 1.0 inch. An axial bore passing completely through the hair brush receives the drive shaft 6. The hair brush body 4 and bristles 5 are preferably molded as a unit. In the preferred embodiment, the bristles are molded into eight longitudinal rows, the rows being spaced circumferentially around the body 4 at intervals of 45° of arc. In the alternative, the rows may be spaced at intervals of 30°. Each of the longitudinal rows contains 10 to 11 bristles spaced between $\frac{1}{4}$ inch and $\frac{1}{2}$ inch apart, depending upon the thickness of the hair being brushed. The bristles are $\frac{3}{4}$ of an inch long and are tapered from a base diameter to the tip. The tip of the bristle may be rounded for comfort when in contact with the scalp.

The axial bore within the hair brush widens at a rear wall 7 to accomodate a first pair of washers 8, a spring 10, a second pair of washers 9, and a thumb nut 11. Thumb nut 11 is received on the forward end of the drive shaft 6 by threaded connection 12. Thumb nut 11 contacts the forward face of the second washers 9, which in turn compress spring 10 against the forward face of washers 8, which in turn provide a rearward force on the body 4 of the hair brush at wall 7. The thumb nut 11 extends forwardly of the forward wall 13 of the hair brush a distance sufficient to allow it to be grasped and turned by a user.

At the rearward end of the hair brush is a thrust collar 14 coaxial with drive shaft 6 and brush body 4. Pin 15 extending through the thrust collar 14 and drive shaft 6 serves to fix the thrust collar 14 against axial displacement along the drive shaft and to compel rotation of the thrust collar with the drive shaft. Between thrust collar 14 and main body 4 is a thrust bearing 16, frictionally connecting the thrust collar and the main body 4. The thrust bearing 16 transmits torque from the drive shaft to the hair brush. If a sufficient external force, such as tangled hair, causes the rotation of the hair brush to stop, the thrust bearing 16 will allow the drive shaft, thrust collar and thumb nut to continue to rotate. Therefore, the thrust collar 16 is a friction engaging means between the drive shaft and the hair brush which allows for an upper limit of the torque that may be transmitted from the hair brush.

The upper limit of torque that may be transmitted from the drive shaft to the hair brush is governed by the amount of compression in the spring 10, which pushes on rearwall 7 through the first washers 8. The amount of compression in spring 10 may be adjusted by turning thumb nut 11 along its threaded connection with the drive shaft. If the thumb nut 11 is completely unscrewed from the drive shaft, the brush may be slipped off of the drive shaft and easily replaced with another brush.

The handle assembly 2 comprises handle 20, an essentially hollow shell that may advantageously be molded from high impact resistant plastic. The handle preferably has a curved slender shape, making it easy and comfortable to grip. The handle 20 receives the drive shaft 6 through a drive shaft bearing 17 mounted in a forward wall 21 of the housing 20. The drive shaft extends rearwardly through the housing to a point just forward of driving means 22, which comprises a reversible direct current motor. A direct current gear motor of known design may advantageously be used as the driving means 22. (A preferred gear motor is type FYQF, part number FYQM 33410-40 of Barber-Colman Co. of Loves Park, Ill., which turns the drive shaft at 38 RPM at full load with a torque of 40.5 in.-oz.) The driving means 22 may be supported within housing 20 by means such as integrally molded forward motor mounting wall 24 and integrally molded rear motor mounting wall 25. Driving means 22 comprises power take off 23, which receives drive shaft 6. The drive shaft may be secured to the power take off by set screw 26 or equivalent means.

Driving means 22 is electrically controlled by brush switch 27 mounted in an upper wall of handle 20, as shown in FIG. 3. Brush switch 27 is a double pole-double throw switch with ON-OFF-ON switching functions. Advantageously, both ON positions may be of the "momentary" type, in which continuous thumb pressure is required to maintain the ON position. The two ON positions are used, respectively, to achieve clockwise and counter-clockwise rotation of drive shaft 6 by reversing the polarity of the direct current supplied to driving means 22. Direct current for the driving means 22 is supplied by the four-wire conductor means 53 entering handle 20, as shown in FIG. 3. Given the above discussion, the electrical connection between conductor 53, brush switch 27 and driving means 22 will be apparent to those of ordinary skill in the art.

Figure 4:
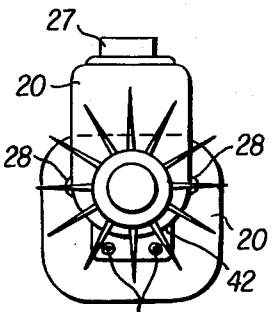
FIG. 4 is an external end view of FIG. 3, taken from the forward end of the assembly.

On the exterior of handle 20 are a first pair of parallel tracks 28, best seen in FIGS. 3 and 4. The tracks 28 are parallel to a pair of first elongate electrical connectors 29, integral with housing 20 at its bottom. In the preferred embodiment, the connectors 29 are female. Connectors 29 are provided with alternating current directly from four-wire conductor 53.

Figure 5:
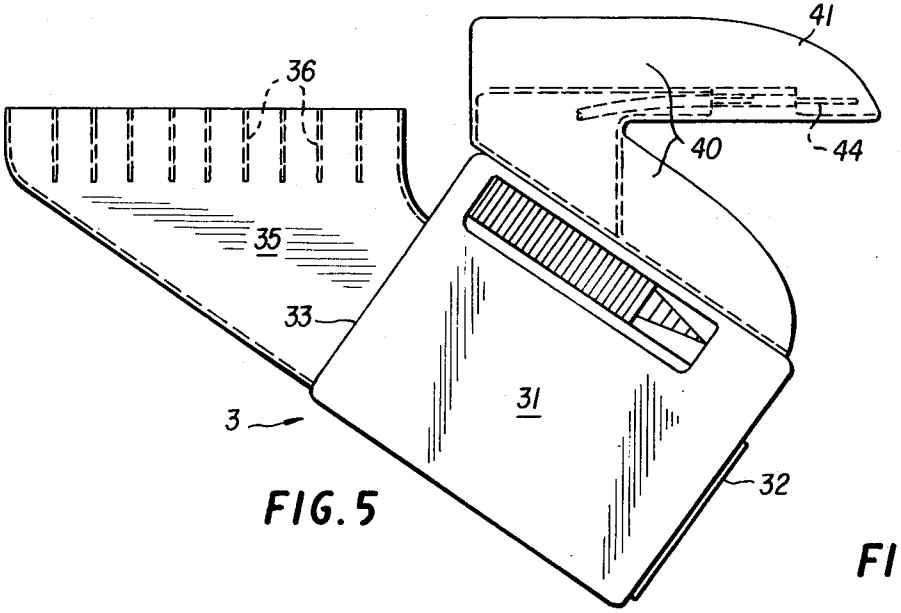
FIG. 5 is a side view of the blower and its mounting bracket.

FIG. 5 shows blower assembly 3, comprising blower 31 and mounting bracket 40 fixed to blower 31. Mounting bracket 40 comprises attachment means for slidably connecting blower 31 with handle 6.

Blower 31 is designed to be powered by alternating current. Except for the nature of the electrical connection, the internal construction of blower 31 forms no part of this invention. Blower 31 may advantageously include a multiple position switch 34 for selecting from among a range of available heat settings. (A modified Ambassador Mini Travel Compact Dryer model MD 1200 available from Allied Stores International, New York, N.Y. has been used with success in an experimental prototype of this invention.)

Figure 6:
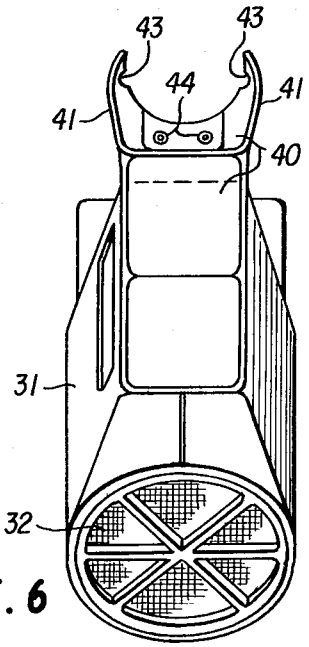
FIG. 6 is a rear view of FIG. 5, showing the air inlet of the blower.

Mounting bracket 40 comprises arcuate arms 41 (FIG. 6) that conform to a curved under surface 42 (FIG. 4) of handle 20 when the blower is mounted on the handle. Arcuate arms 41 comprise second parallel tracks 43 that slidingly engage first parallel tracks 28 in mounting the blower to the handle 20. Mounting bracket 40 further comprises second elongate electrical connection means 44 that slidingly engage the first electrical connection means 29 of handle 20 when the blower is mounted on the handle. In the preferred embodiment, the second elongate electrical connection means 44 are female pins.

As may be seen from FIG. 2, the mounting bracket 40 configures blower 31 such that it lies substantially beneath handle 20 and blows air at an angle toward the hair brush. The blower may be advantageously positioned such that at least one half of the hair brush lies forward of a line drawn normal to the drive shaft from the forward-most portion of the blower 31. The blower is mounted on the bottom of the handle directly opposite brush switch 27, and is substantially symmetric about a plane passing through the drive shaft 6 and the brush switch 27. In this configuration, the blower is well-positioned to blow air across the brush and the hair of the user when the handle is grasped by either hand of a user and the thumb of the user rests on brush switch 27.

Optional removable baffle 35 (FIGS. 2 and 8) may advantageously be made of molded high impact resistant plastic. It is shaped so that it will redirect air leaving blower outlet 33 into a direction normal to the axis of the drive shaft 6. This is accomplished using a series of integral fins 36. The baffle may be curved as at 37 to receive without interference the bristles 5.

Four-wire conductor 53 advantageously comprises one pair of 16 gage copper strand wire, one pair of 24 gage copper strand wire and sufficient insulation around both pairs so that the conductor 53 may be classified as a heater cord. Conductor 53 is supplied simultaneously with alternating current and direct current by power supply 50.

Power supply 50 comprises prongs 51 for insertion into a standard electrical outlet. Within casing 52 of power supply 50 is a known transformer for converting 120 volt AC supplied through prongs 51 to 12 volt DC. (Part number FC 120-0275 available from Dynamic Instrument Corporation, Hauppauge, N.Y. has been successfully modifed and used in an experimental prototype of this invention.) In a manner that will be well understood by those of ordinary skill in the art, a second current path may be provided in parallel with the transformer, directly connecting prongs 51 and conductor 53. In this manner, power supply 50 may simultaneously supply conductor 53 with 120 volt alternating current and 12 volt direct current.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A motorized hair-styling device comprising:

a handle assembly configured for being held in the hand of a user;

a drive shaft rotatably mounted on said handle assembly and extending therefrom;

a source of mechanical power for rotating said drive shaft;

a hair brush rotatably mounted on said drive shaft exterior to said handle assembly;

friction engaging means mounted on said drive shaft and comprising a first engaging surface;

a second engaging surface on said hair brush;

means urging said first and second engaging surfaces into mutual contact, said friction engaging means and said second engaging surface comprising means for transmitting torque from said drive shaft to said hair brush and for allowing relative slippage between said first and second engaging surfaces at drive shaft torques greater than a maximum torque value; and adjustment means disposed within said hair brush for changing the magnitude of said maximum torque value.

2. A motorized hair-styling device as in claim 1, comprising a collar fixed to said drive shaft and a thrust bearing for transmitting torque through said collr to said hair brush.

3. A motorized hair-styling brush as in claim 1, compising spring means on a portion of said drive shaft, first washer means on said drive shaft at one end of said spring means for transmitting the force of said spring means to said hair brush, second washer means on said drive shaft at the other end of said spring means for holding said spring means compressed, said spring means and said first and second washer means all being located in a space within said hair brush, and holding means on said shaft operatively associated with said second washer means for holding said second washer means in place to compress said spring means.

4. A motorized hair-styling brush as in claim 3, wherein said holding means comprises an adjustment means for altering the compression of said spring means, said holding means being threadedly connected on an end of said drive shaft and passing outwardly through an opening in the end of said hair brush nearest said end of said drive shaft.

5. A motorized hair-styling brush as in claim 1, wherein said hair brush comprises a main body of circular cross-section having an outer diameter between 0.5 and 1.0 inch, inclusive, and bristles attached to said main body, said bristles extending radially outward from said main body and being disposed thereon in longitudinal rows spaced circumferentially around said main body at intervals of 45 degrees of arc, each row containing individual bristles spaced at a longitudinal distance of between than one quarter inch and one half inch, inclusive.

6. A motorized hair-styling brush as in claim 1, wherein said hair brush comprises a main body of circular cross-section having an outer diameter between 0.5 and 1.0 inch, inclusive, and bristles attached to said main body, said bristles extending radially outward from said main body and being disposed thereon in longitudinal rows spaced circumferentially around said main body at intervals of 30 degrees of arc, each row containing individual bristles spaced at a longitudinal distance of between than one quarter inch and one half inch, inclusive.

* * * * *